United States Patent [19]

Haman et al.

[11] Patent Number: 4,891,026

[45] Date of Patent: Jan. 2, 1990

[54] MARINE PROPELLER INCLUDING FISH LINE TRAP

[75] Inventors: David F. Haman; Mark C. Noble, both of Waukegan, Ill.

[73] Assignee: Outboard Marine Corporation, Waukegan, Ill.

[21] Appl. No.: 223,222

[22] Filed: Jul. 22, 1988

[51] Int. Cl.[4] ..... B63H 1/28

[52] U.S. Cl. ..... 440/73; 416/247 A; 416/146 R

[58] Field of Search ..... 440/71, 73, 89; 416/247 A, 93 A, 146 R, 146 B

[56] References Cited

U.S. PATENT DOCUMENTS

| | | | |
|---|---|---|---|
| 1,649,657 | 11/1927 | Blake | 115/40 |
| 3,467,051 | 9/1969 | Shimanckas | 115/34 |
| 3,967,446 | 7/1976 | Harralson et al. | 440/89 X |
| 4,180,368 | 12/1979 | Henrich et al. | 416/146 |
| 4,236,872 | 12/1980 | Metclaf | 416/146 |
| 4,447,214 | 5/1984 | Henrich | 440/66 |
| 4,578,040 | 3/1986 | Sumino et al. | 440/73 |
| 4,609,361 | 9/1986 | Sumino et al. | 440/73 |
| 4,676,758 | 6/1987 | Dennis | 440/73 |
| 4,722,667 | 2/1988 | Rikhy et al. | 416/247 A |

FOREIGN PATENT DOCUMENTS

| | | |
|---|---|---|
| 59-100095 | 6/1984 | Japan . |
| 59-164295 | 9/1984 | Japan . |
| 256544 | 3/1971 | U.S.S.R. . |

*Primary Examiner*—Sherman D. Basinger

*Attorney, Agent, or Firm*—Michael, Best & Friedrich

[57] ABSTRACT

Disclosed herein is a marine propulsion device including a lower unit having a gear case normally submerged in water and a propeller rotatably mounted in and extending rearwardly of the gear case. One or more grooves in the outer surface of the forward portion of the propeller outer hub in front of the propeller blade serves to trap and store fish line or the like which becomes entangled in the propeller and thereby prevent such materials from entering the gear case. The groove extends around at least a portion of the outer periphery of the forward position of the propeller outer hub, includes one or more portions which are open to a hollow interior area in the propeller, and has sufficient dimensions to serve as a barrier against propagation of fish line or the like along the outer surface of the propeller outer hub toward the gear case.

15 Claims, 3 Drawing Sheets

MARINE PROPELLER INCLUDING FISH LINE TRAP

This invention relates to marine propulsion devices, such as outboard motors and stern drive units, including a gear case normally submerged in water and propellers therefor and, more particularly, to such devices and propellers including means for preventing fish line and similar materials from entering the gear case.

During operation of an outboard motor or stern drive unit, fish line discarded by the fisherman or similar material can become entangled in the propeller. The entangled material tends to propagate toward the propeller shaft which is the center of rotation and eventually become wrapped around the propeller shaft inside the gear case. When this occurs, the rotating fish line can damage the propeller shaft oil seals by physical abrasion and/or by melting and flowing between the oil seal and the propeller shaft.

Attention is directed to the following U.S. Pat. Nos.:

| Inventor | Patent No. | Issue Date |
|---|---|---|
| Blake | 1,649,657 | November 15, 1927 |
| Shimanckas | 3,467,051 | September 16, 1969 |
| Henrich et al. | 4,180,368 | December 25, 1979 |
| Metcalf | 4,236,872 | December 2, 1980 |
| Henrich | 4,447,214 | May 8, 1984 |
| Sumino et al. | 4,578,040 | March 25, 1986 |
| Sumino et al. | 4,609,361 | September 2, 1986 |
| Dennis | 4,676,758 | June 30, 1987 |

Attention is also directed to Russian Patent No. 256,544 and Japanese Patent Nos. 59-100095 and 59-164295.

SUMMARY OF THE INVENTION

The invention provides a marine propulsion device including a lower unit having a gear case normally submerged in water, a propeller shaft rotatably mounted in the gear box and having a rear portion which extends rearwardly of the rear end of the gear case and carries a propeller having an outer hub carrying a radially extending blade having a leading edge. The outer hub has a forward portion in front of the leading blade edge and includes an outer surface, an inner surface defining a hollow interior area, and means for trapping and storing fish line and similar materials including a groove in the outer surface in the forward portion of the propeller outer hub. This groove extends around at least a portion of the outer periphery of the forward portion of the outer hub and has a portion which opens through the inner surface of the outer hub into the interior area.

The groove preferably has sufficient dimensions to serve as a barrier against propagation of fish line or the like along the outer surface of the forward portion of the propeller outer hub toward the gear case. The groove preferably includes one or more slots which open into the hollow interior area of the propeller and are separated by solid segments. The fish line or the like becomes wrapped around the segment(s).

In one embodiment, the gear case terminates in a rear surface, the gear case interior has a circular inner surface adjacent the rear surface and the portion of the propeller outer hub including the groove extends adjacent the circular inner surface of the gear case.

In one embodiment, the gear case and propeller are arranged to provide through-the-hub exhaust, the propeller includes an inner part mounted on the propeller shaft for common rotation therewith and the propeller outer hub is drivingly connected to the inner part by a plurality of circumferentially-spaced, radially extending ribs. The groove extends completely around the outer periphery of the forward portion of the propeller outer hub and opens into the interior exhaust passage in the propeller, except at locations where the ribs are connected to the outer hub.

The invention also provides a propeller for a marine propulsion device and adapted to be mounted on the rear portion of a propeller shaft for common rotation therewith. The propeller includes an outer hub carrying a radially extending blade having a leading edge. The outer hub has a forward portion in front of the leading edge of the blade, an outer surface, an inner surface defining a hollow interior area, and means for trapping fish line or similar material including a groove in the outer surface of the hub forward portion. The groove extends around at least a portion of the outer periphery of the forward portion of the outer hub and has a portion which opens through the inner surface of the outer hub into the interior area.

In one embodiment, the portion of the outer hub including the groove has an inner surface defining a hollow interior area and the groove extends around the outer periphery of the outer surface of the forward hub portion.

In one embodiment, the groove includes a plurality of circumferentially-spaced slots.

In one embodiment, the propeller includes an inner part having an outer surface, the outer hub has an inner surface spaced radially outwardly from the outer surface of the inner part, a plurality of circumferentially-spaced, radially extending ribs drivingly connect the inner part with the outer hub and cooperate with the outer hub and the inner part to define a passage through which the exhaust gases are discharged rearwardly into the water exteriorly of the outer hub and the groove extends completely around the outer periphery of the outer surface of the forward hub portion and opens through the inner surface of the hub forward portion into said passage except at locations where said ribs are connected to said outer hub.

One of the principal features of the invention is the provision of a marine propulsion device including a gear case normally submerged in water, a propeller rotatably mounted in and extending rearwardly of the rear case and simple, reliable means for preventing fish line and similar material which could become entangled with a propeller from entering the gear case.

Another of the principal features of the invention is the provision of such a marine propulsion device wherein the last-mentioned means is arranged to trap and store fish line and the like propagating along the outer surface of the propeller outer hub toward the gear case.

A further of the principal features of the invention is a provision of such a marine propulsion device wherein the trap and store means includes a groove which is located in the forward portion of the propeller outer hub in front of the propeller blades and is of sufficient dimensions to serve as a barrier for fish line and the like propagating along the outer surface of the propeller outer hub toward the gear case.

A still further of the principal features of the invention is the provision of a marine propeller including means for preventing the propagation of fish lines or the like along the outer hub.

Other features, aspects and advantages of the invention will become apparent to those skilled in the art upon reviewing the detailed description, the drawings and the appended claims.

Figure 1:
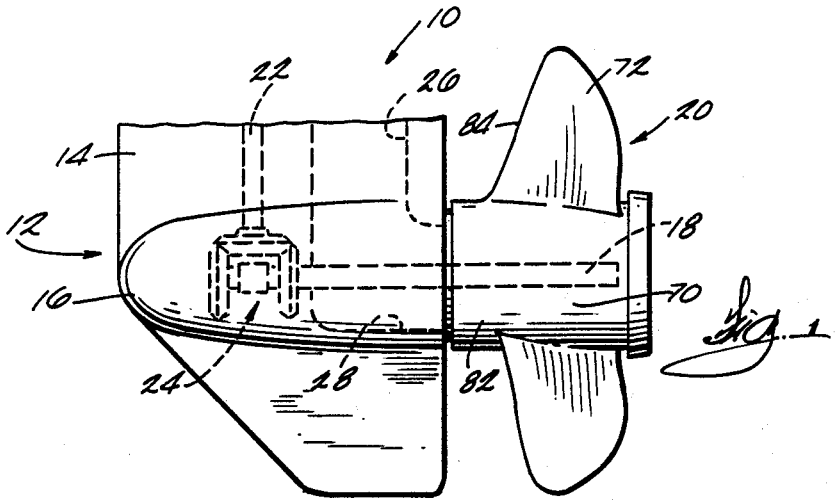
FIG. 1 is a fragmentary view of the lower unit of a marine propulsion device which includes a through-the-hub exhaust and which incorporates various features of the invention.
Figure 2:
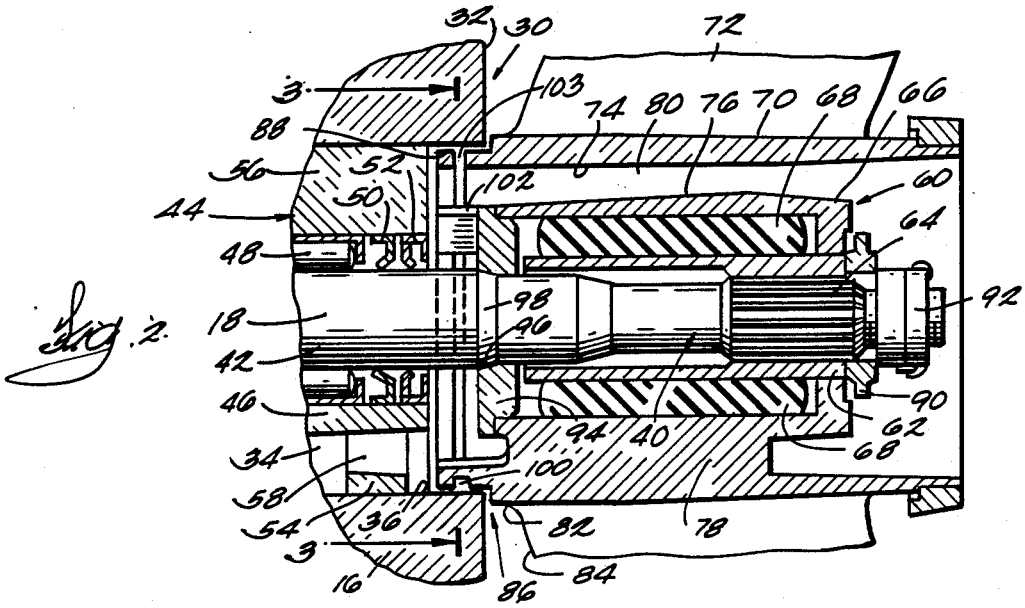
FIG. 2 is an enlarged, fragmentary, cross sectional view of the rear portion of the gear case and the propeller of the marine propulsion device illustrated in FIG. 1.

Before explaining at least one of the embodiments of the invention in detail, it is to be understood that the invention is not limited in its application to the details of construction and the arrangement of components set forth in the following description or illustrated in the drawings. The invention is capable of other embodiments and being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated fragmentarily in FIG. 1 is a marine propulsion device 10, which can be either a stern drive unit or an outboard motor, including a propulsion or lower unit 12 having a driveshaft housing 14 and a gear case 16 which is normally submerged in water.

Rotatably mounted in the gear case 16 is a propeller shaft 18 carrying a propeller 20 rearwardly of the gear case 16. Extending through the driveshaft housing 14 transversely to the propeller shaft 18 is a rotatably mounted driveshaft 22 which, at the upper end, is operably connected to an internal combustion engine (not shown) and, at the lower end, is drivingly connected to the propeller shaft through a conventional reversing clutch or transmission 24.

Extending through the driveshaft housing 14 is an engine exhaust passage 26 which communicates with an exhaust gas discharge passageway 28 in the gear case 16. Engine exhaust gases are discharged into the water from the rear or aft end of the gear case 16 as explained in more detail below.

The gear case 16 has a rear end 30 which terminates in a rearwardly facing surface 32. The gear case 16 has a hollow interior 34 including at its rear a circular inner surface 36 adjacent the rear surface 32.

The propeller shaft 18 includes an aft or rear portion 40 extending rearwardly of the gear case 16 and a forward portion 42 rotatably supported inside the gear case 16 by a retainer bearing 44 suitably affixed to the interior of the gear case 16. The bearing retainer 44 includes a central hub portion 46 carrying a roller bearing 48 and a pair of lubricant seals 50 and 52. The bearing retainer 44 also includes an annular outer sleeve 54 engaging the interior of the gear case 16 and a plurality of circumferentially spaced, radially extending spokes or ribs 56 interconnecting the hub 46 and the sleeve 54. Openings 58 defined between the ribs 56 are in communication with the exhaust gas discharge passageway 28 in the gear case 16 and serve as ports through which the engine exhaust gases are discharged rearwardly from the gear case 16.

In the specific construction illustrated in FIGS. 1–4, the propeller 20 has an inner part 60 including an inner hub 62 mounted on the rear portion 40 of the propeller shaft 18 for common rotation therewith, such as by splines 64, and an intermediate hub 66. The inner hub 62 is connected to the intermediate hub 66 by a resilient member 68. The resilient member 68 is suitably connected or bonded to both the inner and intermediate hubs 62 and 66 so as to absorb shock and permit a limited amount of relative rotation between the inner and intermediate hubs 62 and 66.

The propeller 20 also includes an outer hub 70 carrying a radially extending propeller blade 72 and having an inner surface 74 radially spaced outwardly from the outer surface 76 of the intermediate hub 66. The outer hub 70 is drivingly connected to the intermediate hub 66 by at least one radially extending spoke or rib 78. The rib 78 can extend perpendicularly or tangentially to the inner surface 74 of the outer hub 70. In the specific construction illustrated, the outer hub 70 is connected to the intermediate hub 66 by three ribs 78 which are circumferentially spaced at equal intervals. Engine exhaust gases being discharged rearwardly from the gear case 16 pass through a passage 80 defined between the intermediate and outer hubs 66 and 70 and the openings between the ribs 78 and are discharged rearwardly into the water exteriorly of the outer hub 70.

The outer hub 70 includes a forward portion 82 which is located in front of the leading edge 84 of the propeller blade 72 and terminates in an offset or recessed portion 86. The recessed portion 86 has a circular outer surface 88 which has an outside diameter less than the inside diameter of the circular inner surface 36 of the gear case 16 and extends adjacent the circular inner surface 36.

In the specific construction illustrated, the propeller 20 is retained on the propeller shaft 18 by suitable means for preventing significant relative axial movement and for providing transmission of reverse thrust of the intermediate hub 66 to the propeller shaft 18, such as by a washer 90 and a nut 92. Forward thrust is transmitted through the intermediate hub 66 to the propeller shaft 18 through a thrust washer 94 including a central aperture 96 adapted to engage a frusto-conical thrust bearing surface 98 on the rear portion 40 of the propeller shaft 18.

Fish line and other similar material which becomes entangled in the propeller 20 tends to propagate along the outer surface of the forward portion 82 of the outer hub 70 toward the gear case 16 and, in some cases, eventually becomes wrapped around the propeller shaft 18 adjacent the oil seal 52. The invention provides means for trapping fish line or the like in the forward portion 82 of the outer hub 70 and retaining or storing it there until removed by the user. Such means includes one or more grooves on the outer surface of the forward portion 82 of the outer hub 70 of sufficient dimensions (e.g., length, width and depth) to serve as a barrier against propagation of fish line or the like toward the gear case 16.

Figure 3:
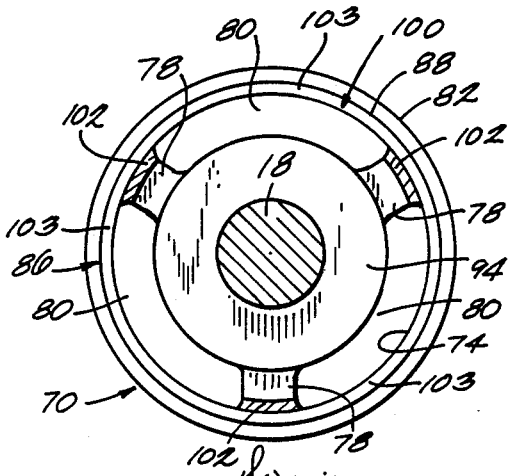
FIG. 3 is a view taken generally along line 3—3 in FIG. 2, shown before fish line has been trapped and stored.

In the specific construction illustrated in FIGS. 1–4, a groove 100 is provided in the recessed portion 86 of the outer hub 70. As best shown in FIG. 3, the groove 100 extends completely around the outer periphery of the recessed portion 86 and opens through the inner surface 74 of the outer hub 70 into the passage 80, except at locations or segments 102 where the ribs 78 are connected to the outer hub 70. Thus, the groove 100 has three equally circumferentially-spaced openings or slots 103.

The groove 100 is located far enough forwardly of the rear end 30 of the gear case 16 so that it does not provide a direct leakage path for engine exhaust gases from the gear case exhaust passageway 28 into the water in front of the propeller blades 72. Such leakage could adversely affect propeller performance.

Figure 4:
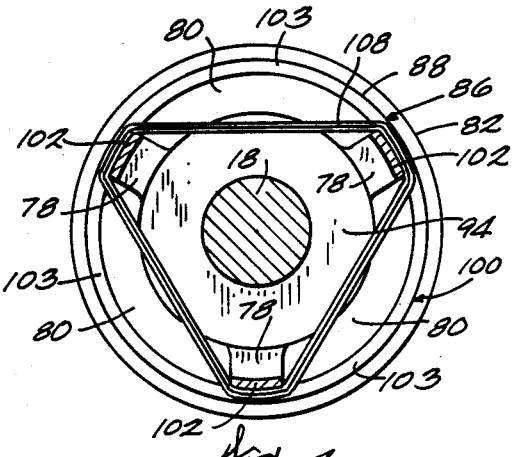
FIG. 4 is a view similar to FIG. 3, shown after fish line has been trapped and stored.

Fish line 108 entangled with propeller 20 and propagating along the outer surface of the outer hub 70 toward the gear case 16 slips into the groove 100. The centripetal force imparted on the fish line 108 by the rotating propeller 20 causes it to move through the slots 103 toward the center of rotation (i.e., the propeller shaft 18) and it becomes wrapped tightly around the segments 102 in a triangular pattern as shown in FIG. 4. Once the fish line 108 is wrapped into the slots 103, the centripetal force imparted by the rotating propeller prevents it from moving out of the groove 100.

The fish line 108 is retained or stored in the groove 100 until removed by a user. This can be accomplished by simply removing the propeller 20 and either unwinding the fish line or cutting it away with a knife or scissors.

Figure 5:
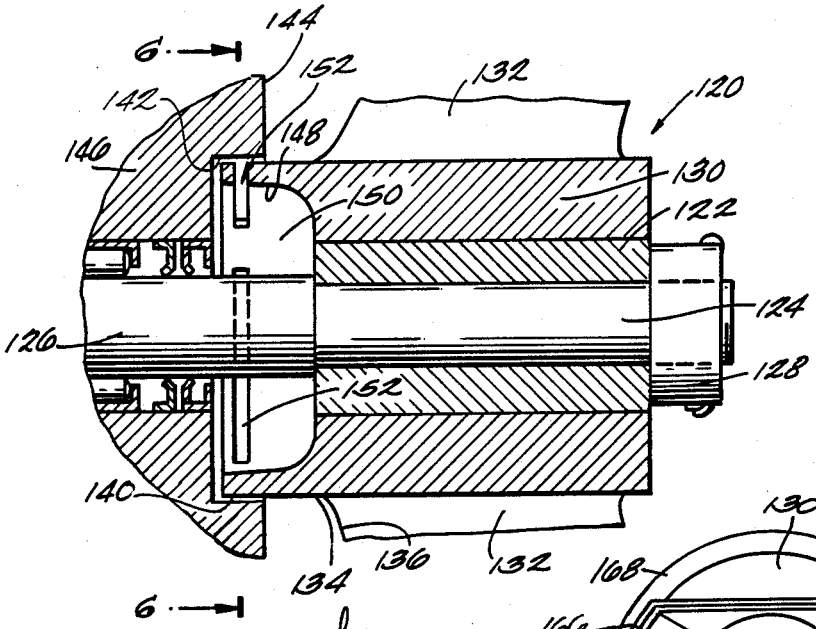
FIG. 5 is a fragmentary, cross sectional view of the rear portion of the gear case and the propeller of a marine propulsion device which does not employ a through-the-hub exhaust and which incorporates various features of the invention.
Figure 6:
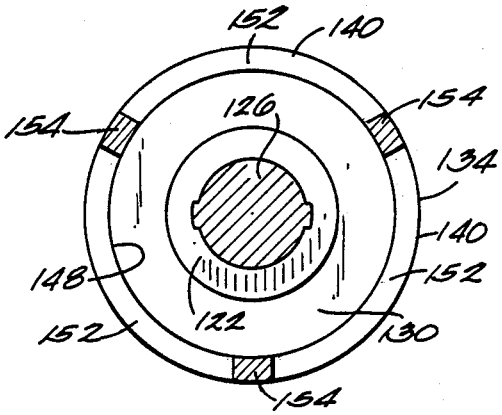
FIG. 6 is a view taken generally along line 6—6 in FIG. 5, shown before fish line has been trapped and stored.
Figure 7:
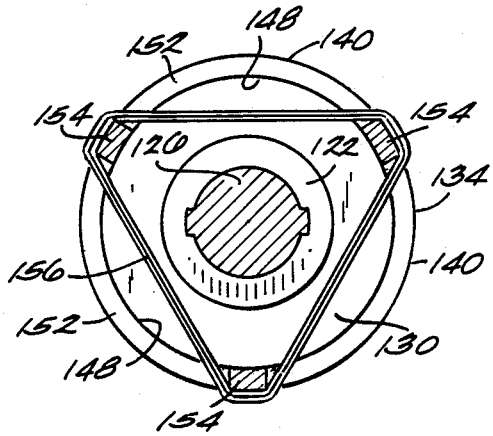
FIG. 7 is a view similar to FIG. 6, shown after fish line has been trapped and stored.

FIGS. 5–7 illustrate a propeller 120 for an outboard motor which does not employ a through-the-hub-exhaust system. Instead, the engine exhaust gases are either routed over the outside of the propeller or through an exhaust passage remote from the propeller.

In the specific construction illustrated, the propeller 120 has an inner part or hub 122 mounted on the rear portion 124 of a propeller shaft 126 for common rotation therewith and retained thereon by a nut 128 or the like. The propeller 120 also has an outer hub 130 which carries a radially extending propeller blade 132 and is drivingly connected to the inner hub 122 in a suitable manner.

Similar to the construction illustrated in FIGS. 1–4, the outer hub 130 includes a forward portion 134 which is located in front of the leading edge 136 of the propeller blade 132. The forward portion 134 has a circular outer surface 140 which has a diameter less than the inside diameter of a circular inner surface 142 in the rear end 144 of the gear case 146 and extends adjacent to the circular inner surface 142. The outer hub 130 has an inner surface 148 which defines an open or hollow interior area 150 rearwardly of the rear end 144 of the gear case 146.

At least one slot 152 is provided in the forward portion 134. The slot 152 is open through the inner surface 148 of the outer hub 130 into the interior area 150. In the specific construction illustrated, a plurality (e.g. 3) of circumferentially spaced slots 152 are provided, preferably of equal length and equally spaced. The segments 154 between the slots 152 can be ungrooved as illustrated or have shallow grooves, so long as sufficient material remains to provide the forward portion 134 of the outer hub 130 with the required structural integrity.

Fish line 156 propagating along the outer surface of the forward portion 134 of the outer hub 130 slips into the slots 152 and becomes wrapped around the segments 154 in a triangular pattern as shown in FIG. 7.

The groove 100 in the embodiment illustrated in FIGS. 1–4 can be at a location on the forward portion 82 of the outer hub 70 where there is no ribs interconnecting the intermediate hub 66 and the outer hub 70. In such case, the groove 100 could consist of one or more slots like the slots 152 in the embodiment illustrated in FIGS. 5–7. Also, for propeller constructions like that illustrated in FIGS. 5–7, internal retainer means can be provided to serve the same function as the ribs 78 in the embodiment illustrated in FIGS. 1–4.

Figure 8:
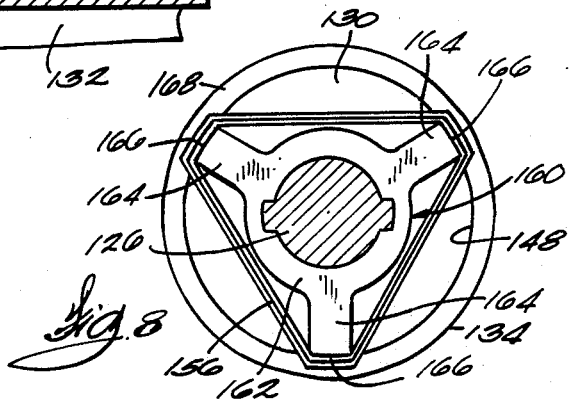
FIG. 8 is a view similar of FIG. 7 of an alternate arrangement of the groove for trapping and storing fish line.

FIG. 8 illustrates such an arrangement. A retainer 160 including a hub 162 is mounted on the propeller shaft 126 for common rotation therewith in the hollow interior area 150 and forwardly of the rear end 144 of the gear case 146. The retainer 160 includes a plurality (e.g., 3) of circumferentially spaced, radially extending spokes 164, each of which has an outer end portion 166 located adjacent the inner surface 148 of the outer hub 130.

A groove 168 is provided in the forward portion 134 of the outer hub 130. Similar to the groove 100 in the embodiment illustrated in FIGS. 1–4, the groove 168 extends completely around the outer periphery of the outer hub 130 and opens into the hollow interior area 150, except at the outer end portions 166 of the spokes 164. The fish line 156 propagating along the outer surface of the forward portion 134 of the outer hub 130 slips into the groove 168 and becomes wrapped tightly around the outer end portions 166 of the retainer spokes 164 in a triangular pattern as shown in FIG. 8.

A similar retainer can be used in through-the-hub exhaust constructions which do not include ribs connected to the outer hub in the area in which the groove is located.

Figure 9:
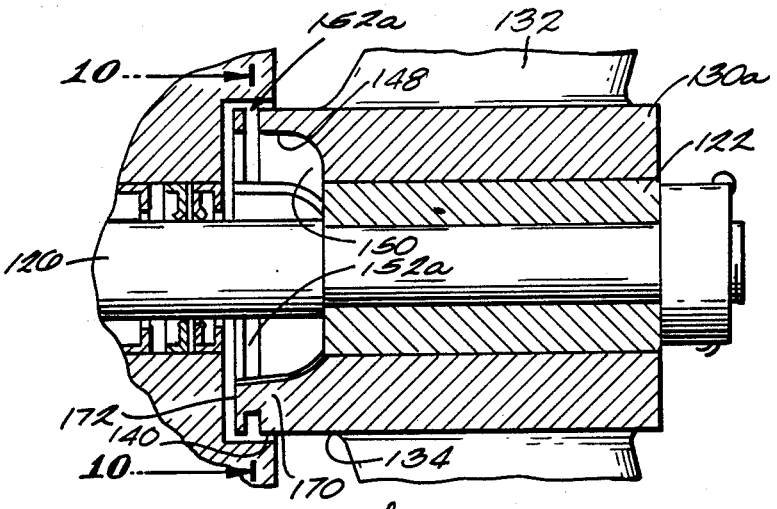
FIG. 9 is a view similar to FIG. 5 of an alternate arrangement of a propeller for a marine propulsion device which does not employ a through-the-hub exhaust.
Figure 10:
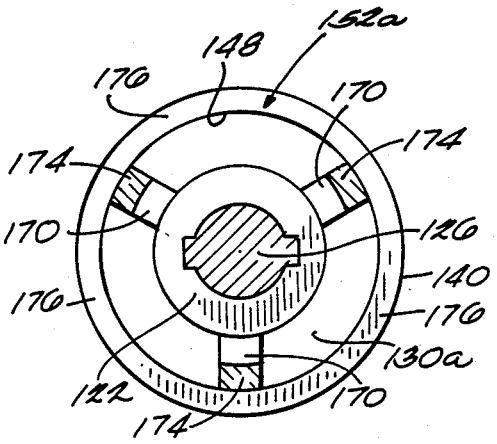
FIG. 10 is a view taken generally along line 10—10 in FIG. 9, shown before fish line has been trapped and stored.
Figure 11:
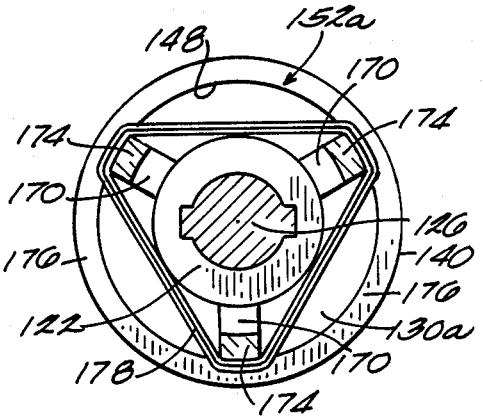
FIG. 11 is a view similar to FIG. 10, shown after fish line has been trapped and stored.

FIGS. 9–11, which are similar to FIGS. 5–7, illustrate an alternate arrangement of a propeller for an outboard motor which does not employ a through-the-hub exhaust. Components common which those in FIGS. 5–7 are identified by the same reference numerals.

The outer hub 130*a* includes at least one rib 170 extending radially inwardly from the inner surface 148 into the interior area 150 and extending forwardly to the forward end 172 of the outer hub 130*a*. In the specific embodiment illustrated, the outer hub 130*a* includes three ribs 170 which are circumferentially spaced at equal intervals. The groove 152a extends completely around the outer periphery of the outer surface 140 and opens through the inner surface 148 into the interior area 150, except at locations or segments 174 where the ribs 170 extend from the inner surface 148. Thus, the groove 152a has three equally circumferentially-spaced openings or slots 176.

Fish line 178 propagating along the outer surface 140 of the forward portion 134 of the outer hub 130a slips into the slots 176 and becomes wrapped around the segments 174 in a triangular pattern as shown in FIG. 11.

The effectiveness of the groove(s) or slots to trap and retain fish line and similar materials is governed primarily by the width and depth, and to some extent by the length, of the groove(s) or slots. The groove(s) or slots can be arranged in a variety of different ways to provide the desired trap and store functions. For instance, a plurality of axially spaced groove(s) can be used. Although less desirable because of reduced storage capacity, the groove(s) do not have to extend completely around the outer periphery of the outer hub. A single groove extending around only a portion of the outer periphery of the outer hub and including at least a portion which opens into a hollow interior area can be used.

We claim:

1. A marine propulsion device comprising a lower unit including a gear case normally submerged in water and having a rearward end, a propeller shaft rotatably supported in said gear case and having a rear portion extending rearwardly of the rearward end of said gear case, a propeller mounted on the rear portion of said propeller shaft for common rotation therewith and including an outer hub carrying a radially extending blade having a leading edge, said outer hub including a forward portion in front of the leading edge of said blade and having a forward end, an outer surface, and an inner surface defining a hollow interior area, and means for trapping fish line or similar material including a groove extending around at least a portion of said outer surface of said hub forward portion and wholly in spaced relation to said forward end thereof and having a portion which opens through said inner surface of said outer hub and into said interior area.

2. A marine propulsion device according to claim 1 wherein said rearward end of said gear case terminates in a rear surface and has a circular inner surface adjacent said rear surface, and wherein said forward portion of said outer hub has a circular outer surface which includes said groove and which extends adjacent said circular inner surface of said gear case.

3. A marine propulsion device according to claim 2 wherein said groove extends around the entire outer periphery of said outer resurface of said forward hub portion.

4. A marine propulsion device according to claim 3 wherein said groove defines a plurality of circumferentially-spaced slots.

5. A marine propulsion device according to claim 4 wherein said slots are substantially the same length and are at equally spaced intervals.

6. A marine propulsion device according to claim 2 wherein said rearward end of said gear case terminates in a rear surface end and has a circular inner surface adjacent said rear surface defining an opening through which exhaust gases are discharged from said lower unit, wherein said propeller includes an inner part having an outer surface and is mounted on the rearward portion of said propeller shaft for common rotation therewith, wherein said outer hub has an inner surface spaced radially outwardly from said outer surface of said inner part, and further including a plurality of circumferentially-spaced, radially extending rigs drivingly connecting said inner part with said outer hub and cooperating with said outer hub and said inner part to define a passage through which the exhaust gases are discharged rearwardly from said gear case into the water exteriorly of said outer hub, and wherein said groove extends completely around said outer surface of said forward hub portion and opens through said inner surface of said outer hub into said passage except at locations where said ribs are connected to said outer hub.

7. A marine propulsion device according to claim 6 wherein said inner part of said propeller is mounted in a substantially axially fixed position on said propeller shaft.

8. A marine propulsion device according to claim 6 wherein said outer hub includes a circular outer surface which includes said groove and which extends adjacent said circular inner surface of said gear case.

9. A marine propulsion device according to claim 2 and further including a retainer mounted on said rear portion of said propeller shaft for common rotation therewith and located in said hollow interior area, said retainer having a plurality of circumferentially spaced, radially extending spokes each including an outer end portion located adjacent said inner surface of said outer hub, and wherein said groove extends completely around said outer surface of said forward hub portion into said hollow interior area, except at locations where said outer end portions of said spokes are adjacent to said inner surface of said outer hub.

10. A propeller for a marine propulsion device and adapted to be mounted on the rear portion of a propeller shaft for common rotation therewith, said propeller including an outer hub carrying a radially extending blade having a leading edge, said outer hub including a forward portion in front of the leading edge of said blade and having a forward end, an outer surface, and an inner surface defining a hollow interior area, and means for trapping fish line or similar material including a groove extending around at least a portion of said outer surface of said forward portion and wholly in spaced relation to said forward end and having a portion which opens through said inner surface of said outer hub and into said interior area.

11. A propeller according to claim 10 wherein said groove extends around the entire periphery of said outer surface of said forward hub portion.

12. A propeller according to claim 11 wherein said groove defines a plurality of circumferentially-spaced slots.

13. A propeller device according to claim 12 wherein said slots are substantially the same length and are at equally spaced intervals.

14. A propeller according to claim 11 and further including an inner part having an outer surface and mounted on the rearward portion of the propeller shaft for common rotation therewith, wherein said outer hub has an inner surface spaced radially outwardly from said outer surface of said inner part, a plurality of circumferentially-spaced, radially extending ribs drivingly connecting said inner part with said outer hub and cooperating with said outer hub and said inner part to define a passage through which exhaust gases are discharged rearwardly into the water exteriorly of said outer hub, and wherein said groove extends completely around said outer surface of said forward hub portion and opens through said inner surface of said outer hub into said passage except at locations where said ribs are connected to said outer hub.

15. A propeller according to claim 11 and further including a retainer located in said hollow interior area and adapted to be mounted on the rear portion of the propeller shaft for common rotation therewith, said retainer having a plurality of circumferentially spaced, radially extending spokes each including an outer end portion located adjacent said inner surface of said outer hub, and wherein said groove extends completely around said outer surface of said forward hub portion and opens through said inner surface of said outer hub into said hollow interior area, except at locations where said outer end portions of said spokes are located adjacent said inner surface of said outer hub.

* * * * *